United States Patent [19]

MacMunn

[11] Patent Number: 4,907,360

[45] Date of Patent: Mar. 13, 1990

[54] THREE-DIMENSIONAL SIGNAGE

[76] Inventor: William G. MacMunn, 361 Mulpus Rd., Lunenburg, Mass. 01462

[21] Appl. No.: 307,160

[22] Filed: Feb. 6, 1989

Related U.S. Application Data

[63] Continuation of Ser. No. 79,462, Jul. 30, 1987, abandoned.

[51] Int. Cl.[4] ..... G09F 7/16

[52] U.S. Cl. ..... 40/552; 40/615

[58] Field of Search ..... 40/612, 615, 607, 596, 40/552

[56] References Cited

U.S. PATENT DOCUMENTS

| | | | |
|---|---|---|---|
| 1,820,913 | 9/1931 | Kelly et al. | 40/552 |
| 1,904,850 | 4/1933 | Boyce et al. | 40/552 |
| 1,906,668 | 5/1933 | Valk | 40/607 |
| 2,076,907 | 4/1937 | Meigs | 40/607 |
| 2,159,458 | 5/1939 | Stoddard | 40/612 |
| 2,193,057 | 3/1940 | Carver | 40/615 |
| 2,584,253 | 2/1952 | Braun, Sr. | 40/615 |
| 2,614,352 | 10/1952 | MacHarg | 40/615 |
| 2,995,848 | 8/1961 | Yetman | 40/552 |
| 3,096,596 | 7/1963 | Magnuson et al. | 40/615 |
| 3,965,596 | 6/1976 | Schröcksnadel | 40/125 |
| 3,981,557 | 9/1976 | Eigenmann | 350/104 |
| 4,123,140 | 10/1978 | Ryan et al. | 350/105 |
| 4,133,125 | 1/1979 | Lariosa | 40/608 |
| 4,176,485 | 12/1979 | Terris | 40/584 |
| 4,189,209 | 2/1980 | Heasley | 350/103 |
| 4,231,830 | 11/1980 | Ryan et al. | 156/232 |
| 4,265,938 | 5/1981 | Jack et al. | 427/163 |
| 4,279,534 | 7/1981 | Eigenmann | 404/72 |
| 4,519,154 | 5/1985 | Molari, Jr. | 40/615 |
| 4,544,586 | 10/1985 | Molari, Jr. | 428/29 |
| 4,563,393 | 1/1986 | Kitagawa et al. | 428/412 |

*Primary Examiner*—Paul J. Hirsch

*Attorney, Agent, or Firm*—Weingarten, Schurgin, Gagnebin & Hayes

[57] ABSTRACT

A three-dimensional road sign portraying the International "DO NOT ENTER" symbol for warning traffic approaching a one way side street from either side of the street. The International "DO NOT ENTER" sign uses vertically separated red and white zones which retain the information content when expanded into a three-dimensional shape. The sign is painted or embossed such that when in place and approached front end on, it is virtually indistinguishable from a conventional "DO NOT ENTER" sign. When approached from either side of the sign, the vertically separated red and white zones are seen as the information that warns the approaching traffic of the one way restriction. A single sign thus warns at a greater distance and angle than the conventional sign and reduces ambiguities.

3 Claims, 1 Drawing Sheet

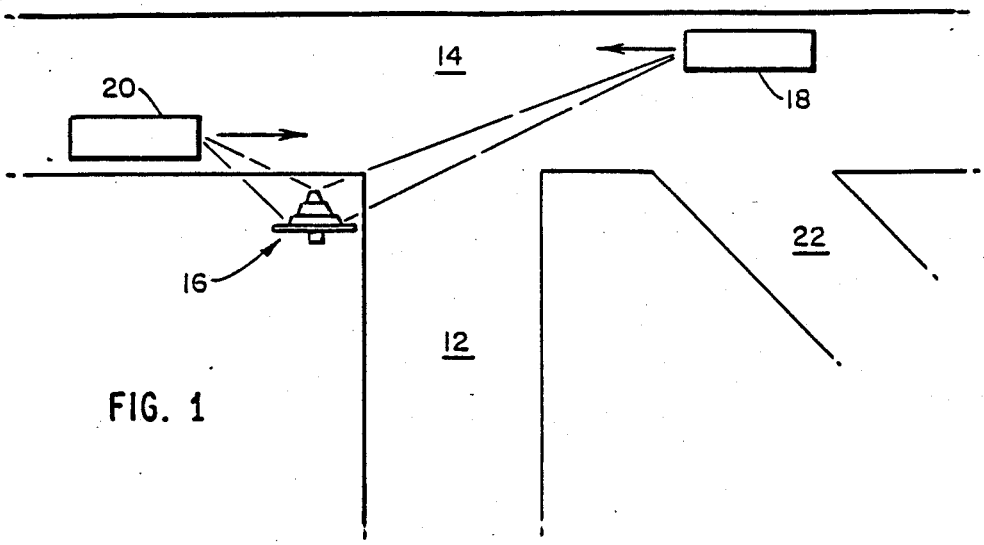
FIG. 1
FIG. 2
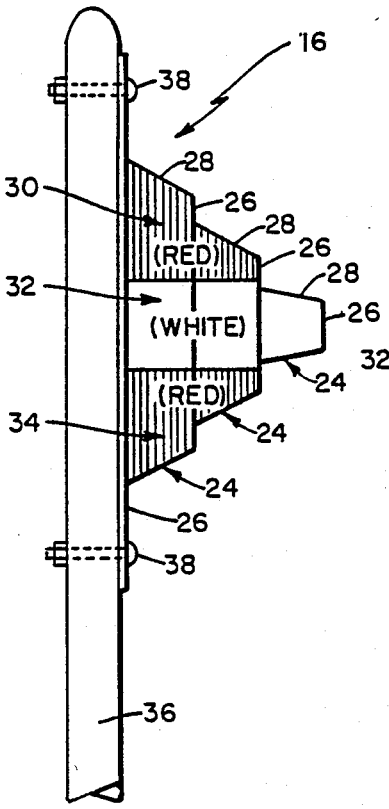
FIG. 3
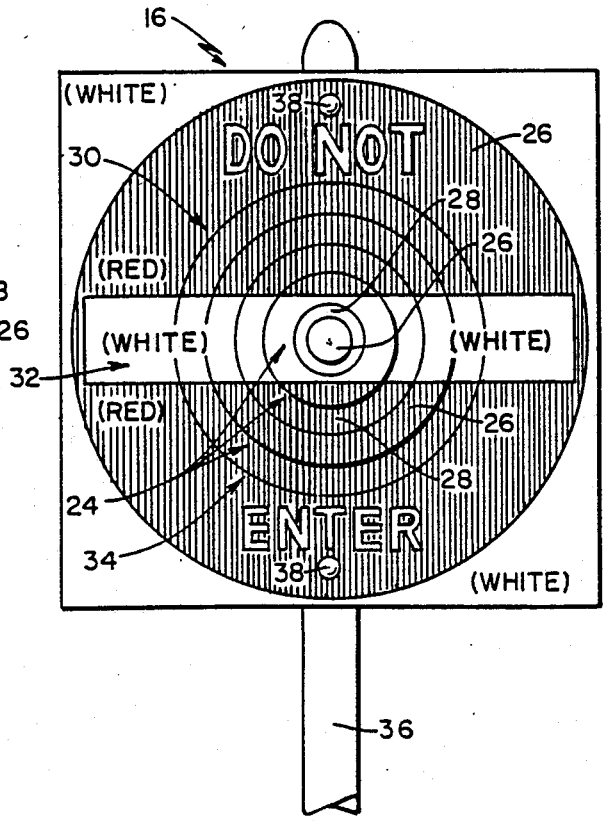

THREE-DIMENSIONAL SIGNAGE

This application is a continuation of application Ser. No. 07/079,462, filed July 30, 1987, now abandoned.

BACKGROUND OF THE INVENTION

This invention relates to road signs, and in particular to the International "DO NOT ENTER" road sign used for warning approaching traffic of a one way road condition preventing entry to a side street or lane. Conventional "DO NOT ENTER" signs are two-dimensional and are commonly mounted on a pole at the junction of a side street or lane with a throughway. The plane of the two-dimensional signs is usually parallel to the direction of the throughway and thus not visible to approaching traffic until right on top of the forbidden entry. A motorist or other road user may therefore not timely observe the "DO NOT ENER" sign, which prohibits turning into a one way street the wrong way, resulting in such hazards as wrong way driving on a high speed divided highway.

The two-dimensional nature of the conventional "DO NOT ENTER" often requires the use of two or more signs in order to warn of the traffic restriction.

SUMMARY OF THE INVENTION

These and other problems of the prior art sign are overcome in accordance with the present invention wherein a DO NOT ENTER sign is provided as a three dimensional surface on which the vertically separated color bands extend across the face of the sign to permit traffic viewing from a wide range of angles, and in particular to permit traffic approaching from 180 degree different directions to perceive the DO NOT ENTER character of a side street at a distance from a single sign.

In one embodiment the DO NOT ENTER sign is a terraced alternation of annular discs and conical bands affixed together in wedding cake fashion and supported with the axis of rotation oriented horizontally. The individual discs and bands may be of metal such as aluminum with the edges welded. Alternatively, the sign may be formed of plastic or other such material which permits the sign to be formed as a one-piece unit, if desired, thereby negating the need for welding or bonding. The sign is affixed to a sign post at opposite points of the largest diameter disc with the red and white international bands extending horizontally.

DESCRIPTION OF THE DRAWING

Some of the objects and features of the invention having been disclosed, others will become apparent as the description proceeds when taken in conjunction with the accompanying drawings, in which:

FIG. 1 is an overhead view portraying the sign of the invention as it would commonly be located on a street corner.

FIG. 2 is a side elevation view indicating the three-dimensional feature of the sign.

FIG. 3 is a front elevation view of the sign.

DETAILED DESCRIPTION

The present invention contemplates a three-dimensional DO NOT ENTER sign which permits traffic viewing over a board angle with a single sign. In particular, and as illustrated in FIG. 1, a side street 12, which terminates at a throughway 14, one way into the throughway 14. A three-dimensional DO NOT ENTER sign 16 according to the invention is placed at a corner of the intersection. The International DO NOT ENTER sign colors consist of vertically separated red, white and red bands, as illustrated in FIGS. 2 and 3, so that a single sign 16 can be perceived by traffic, represented by vehicles 18 and 20, approaching from opposite directions along the way 14, typically 180 degrees apart. The use of the single sign 16 is not only efficient but reduces confusion, particularly where additional side streets, such as side street 22, enter at approximately the same location.

With reference specifically to FIG. 2, an embodiment of the DO NOT ENTER sign according to the present invention is more fully shown. As indicated there, the DO NOT ENTER sign constitutes a set of tiers 24, somewhat in wedding cake fashion, each tier formed of a annular disc 26 and a conical band 28. Where the discs and bands are formed of aluminum, they may be welded or otherwise bonded at their edges forming the complex structure illustrated in FIGS. 2 and 3. The sign is painted, embossed or otherwise marked in the International DO NOT ENTER pattern having vertically separated red and white zones 30, 32 and 34, respectively. The sign may be fabricated of plastic or other material and can be formed as a single element.

The combination of the vertically separated bands, as the information carrying indicia, arrayed around a three-dimensional form provides a traffic warning capable of being understood over a wide angle.

The sign 16 is typically affixed to a post 36 through bolts 38 in opposite portions of the widest of the annular discs 26. The post 36 is placed as the entry to a one way street.

It is to be noted that materials other than those exemplified above may be utilized and that a three-dimensional form other than the tiered arrangement illustrated in FIGS. 2 and 3 may be utilized to produce the three-dimensional sign of the present invention. It is therefore to be noted that the scope of the invention is to be determined solely from the following claims.

I claim:

1. A three-dimensional road sign for providing graphic information over a wide range of angles, comprising:

a planar base member adapted for mounting in a vertical plane;

a three-dimensional member extending outwardly from said base member about an axis extending substantially perpendicular to the plane of said base member, said three-dimensional member having an exterior surface, said exterior surface including at least one disc spaced apart from said base member in a plane parallel to the plane of said base member and at least one conical band joining said at least one disc to said base member, said at least one conical band having a diameter decreasing from said planar base member;

predetermined colors arranged in predetermined zones on said exterior surface of said three-dimensional member and said planar base member, said predetermined zones being vertically separated with said three-dimensional road sign vertically mounted; and wherein said predetermined colors are red and white, said red color arranged in first and second zones and said white color arranged in a centered horizontal band intermediate said first and second red zones to provide the graphic information corresponding to the international DO NOT ENTER indicia; and further wherein said predetermined red and white colors arranged in said predetermined zones in combination with said three-dimensional member permitting viewing of the DO NOT ENTER graphic information over the wide range of angles.

2. The three-dimensional road sign of claim 1 wherein said exterior surface of said three-dimensional member is a tiered structure extending substantially perpendicular to the plane of said base member, said tiered structure including a plurality of discs spaced apart from said base member and each other in planes parallel to the plane of said base member, said plurality of discs having decreasing diameters with increasing distance from said base member; and a plurality of conical bands jointing adjacent ones of said plurality of discs to one another and said base member, respectively, to form said tiered structure.

3. The three-dimensional road sign of claim 2 wherein each of said plurality of discs other than said one disc furthest spaced apart from said base member is an annular disc.

* * * * *